US005473905A

United States Patent [19]

Billman

[11] Patent Number: 5,473,905

[45] Date of Patent: Dec. 12, 1995

[54] SURGE DAMPENING DEVICE FOR CRYOGENIC VAPORIZERS AND HEATER ELEMENTS

[75] Inventor: Patrick R. Billman, Murrieta, Calif.

[73] Assignee: Cryoquip, Inc., Murrieta, Calif.

[21] Appl. No.: 282,916

[22] Filed: Jul. 29, 1994

[51] Int. Cl.[6] ..... F17C 9/02

[52] U.S. Cl. ..... 62/50.2; 165/146; 165/174

[58] Field of Search ..... 62/50.2, 515; 165/146, 165/174

[56] References Cited

U.S. PATENT DOCUMENTS

| | | | |
|---|---|---|---|
| 2,384,858 | 9/1945 | Thayer et al. | 165/142 |
| 2,650,790 | 9/1953 | Fritzberg | 165/142 |
| 4,083,707 | 4/1978 | Bivins, Jr. | 62/50.2 |
| 4,343,156 | 8/1982 | Gauthier | 62/50.2 |
| 4,479,359 | 11/1984 | Pelloux-Gervais | 62/50.2 |
| 5,251,452 | 10/1993 | Wieder | 62/50.2 |

*Primary Examiner*—Ronald C. Capossela
*Attorney, Agent, or Firm*—Harold L. Jackson

[57] ABSTRACT

An improved cryogenic vaporizer and heat-transfer element comprising a tubular housing having outer fin members, a central passage having an upper portion substantially closed to provide a restricted flow of fluid therefrom, an intermediate portion defining a deceleation chamber, and a lower portion in which is mounted a hollow rod that substantially controls the amplitude of liquid surging within the central passage of the housing.

17 Claims, 1 Drawing Sheet

SURGE DAMPENING DEVICE FOR CRYOGENIC VAPORIZERS AND HEATER ELEMENTS

BACKGROUND OF THE INVENTION

1. Field of the Invention

The present invention relates generally to ambient air vaporizers and heaters and more particularly to a surge dampening device for unidirectional flow vaporizers and heaters that use cryogenic fluids operating below fluid critical pressures.

2. Brief Description of the Prior Art

Atmospheric vaporizers which are well known in the art are used in many industries to vaporize relatively large quantities of a cryogenic liquid which is needed in the gaseous form for various manufacturing processes and other operations. A typical example for the use of atmospheric vaporizers/heat exchangers is the vaporization of liquid oxygen for use in industrial welding operations. Basically, an atmospheric vaporizer is a heat exchanger which utilizes ambient heat to vaporize a very low boiling (cryogenic) liquid.

State-of-the-art atmospheric vaporizers/heat exchangers include a plurality of heat exchange elements which are finned tubes made of good heat conducting materials such as aluminum. The finned tubes are mechanically assembled to one another and to a substantially rigid frame. Flow of the cryogenic fluid through the tubes is generally in a serial fashion; that is, from one tube to another to maintain the height of the vaporizer/heat exchanger within reasonable limits, for example, of the order of 6 to 25 or more feet. The relatively large surface of each fin facilitates efficient heat exchange with the environment; in other words, the fins promote relatively efficient absorption of heat required for vaporization and heating of the cryogenic liquid.

As an example of a prior-art serial atmospheric vaporizer/heat exchanger one may refer to U.S. Pat. No. 4,479,359 which includes specific dimensions for the external and internal fins of its elongated finned tubes.

One may also refer to the ambient air vaporizer and heater for cryogenic fluids disclosed in U.S. Pat. No. 5,251,452, ("'452 patent") assigned to the assignee of this application, wherein the present surge dampening device is readily usable therewith as well as with other like vaporizer/heater units.

It is well known in the art that dynamic instability of fluid flow, that is surging, in cryogenic vaporizers often occurs and presents various operational problems. Dynamic instability in flow (surging) in cryogenic vaporizers is a complex function of a number of variables, including vaporizer flow channel geometry, mode of heat transfer, heat flux and flux distribution, degree of subcooling of the inlet liquid, and operating pressures, as well as flow rate and fluid properties. The instability for the type of ambient air vaporizer described herein is caused primarily by a combination of density wave oscillations and pressure wave oscillations. These oscillations are induced by the forced convection film boiling characteristics of subcooled cryogenic fluids, and are considered to be driven by thermal responses of the vapor film to these flow disturbances, which in turn alters heat transfer behavior and pressure drop and further promotes flow disturbances.

Prior art for dampening surging in cryogenic vaporizers typically includes the use of individual orifices in the flowing process stream at the inlet of each parallel flow circuit (each heat transfer element) which constitutes the vaporizer, or a single orifice at the liquid inlet to the vaporizer. However single or multiple inlet orifices alone do not necessarily provide the proper dampening for the operating conditions desired. This is because quite often the amount of orifice restriction in the flowing process stream required to dampen surges to reasonable levels for a particular vaporizer application very often restricts flow to an amount below the required rated flow of the vaporizers, and can also result in a pressure drop that causes flashing of the liquid. The liquid flashing, in turn, creates a two-phase flow condition at the inlet to each parallel flow circuit in the vaporizer, thereby resulting in mal-distribution and reduced capacity of the vaporizer.

Additionally, a vertical surge leg is often provided in the liquid supply line just upstream of the vaporizer in combination with an orifice upstream of the surge leg. The surge leg is uninsulated and allows liquid to enter. Since the leg is uninsulated, heat leak results in a vapor phase at the top of the closed end leg which acts as a spring. Such a device in conjunction with the upstream orifice (both external to the vaporizer) reduces surging by trapping pluses traveling back to the source of liquid supply. Other schemes external to the vaporizer are also used which rely on large gas volumes downstream of the vaporizer in the gas phase are also used.

Further, where liquid supply pressure is high and large pressure drops are permissible, "twisted-tape" type turbulators may be inserted into the flow circuits to enhance heat transfer and provide dampening. However, for relatively low operating pressures, where low pressure drop criteria applies, turbulators do not provide effective dampening.

SUMMARY OF THE INVENTION

In accordance with the present invention there is disclosed an improved heat-exchange unit or heat-transfer element comprising a vaporizer in which is mounted a surge dampening device. This device is defined by an elongated hollow tube having oppositely disposed open ends, the hollow tube being mounted within the lower end of the heat-transfer element which is generally referred to as the boiling portion of the cylindrical central opening of the elongated central passage. The placement of the hollow tube limits the boiling channel to an annular area and simultaneously provides an internal liquid core within the hollow tube. The cylindrical central passage is defined by the outer ends of a plurality of internal projections. The upper end of the cylindrical central opening is preferably adapted to receive a cylindrical rod having a diameter substantially equal to the diameter of the central opening, whereby the central opening is closed at its upper discharging end. The upper positioned cylindrical rod is separated from the lower positioned hollow tube by means of a free space portion.

The characteristics and advantages of the present invention may be best understood by the following description taken in conjunction with the accompanying drawing in which like parts are designated by the same reference numerals. It will understand that variations may be made from the disclosed embodiment without departing from the principles disclosed or the scope of the invention as set forth in the appended claims.

DESCRIPTION OF THE PREFERRED EMBODIMENT

Figure 1:
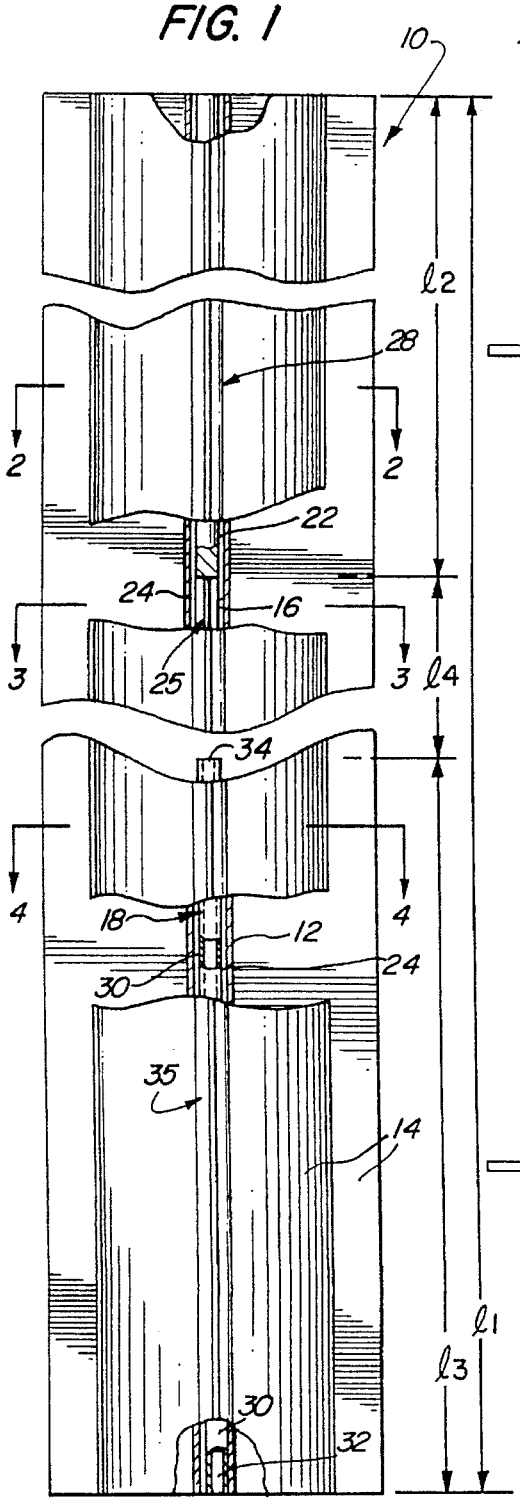
FIG. 1 is a side-elevational view of a heat-exchange element of an ambient air vaporizer and heater for cryogenic fluids in accordance with the present invention, portions being broken away so as to more clearly define the structure thereof.
Figure 2:
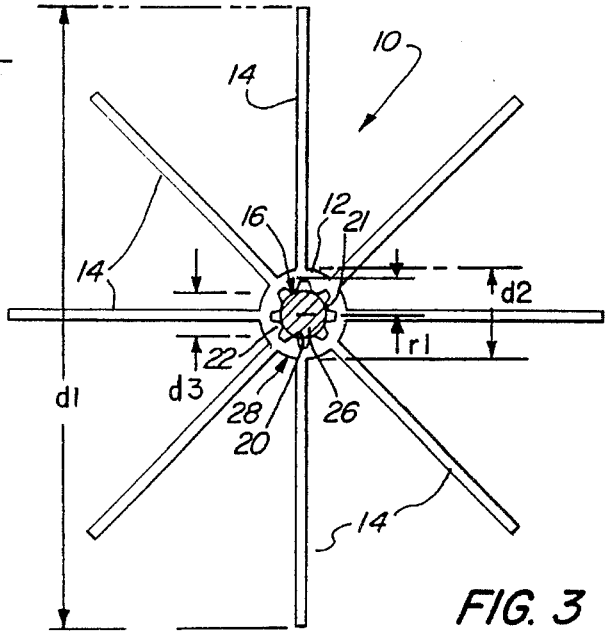
FIG. 2 is an enlarged cross-sectional view taken substantially along line 2—2 of FIG. 1.

Referring now to the drawings and particularly to FIG. 1, there is illustrated a heat-exchange element or unit, generally indicated at 10, which when interconnected to a plurality of heat-exchange units define an ambient air vaporizer and heater for cryogenic fluids, which is not shown, but is well illustrated and described in the '452 patent. These heat-exchange units are generally vertically mounted to a base member and are inter-connected at their upper outlet ends by means of a manifold which is connected to an outlet conduit that conducts vaporized and heated cryogenic fluid. The lower inlet end of each heat-exchange unit is also interconnected to an inlet manifold and receives cryogenic fluid into each of the heat-exchange elements.

Accordingly, heat-exchange unit 10 of the present invention defines a finned heat exchanger tube or housing 12 that has an approximate overall length of between 6 to 40 feet and is preferably extruded from aluminum. Heat exchange tube 12 also includes a plurality of external fins 14 (e.g. 8 in number) extending radially therefrom, and a central passage 16 having a surge dampening means mounted in the lower end, indicated generally at 18, whereby the cryogenic fluid is conducted therethrough. The external fins 14 provide a large surface area through which heat is transferred from the ambient air to cryogenic fluid flowing through the central passage 16.

Figure 3:
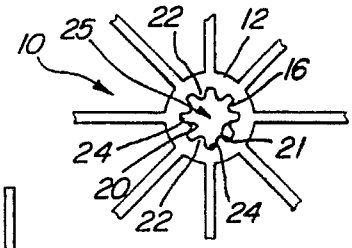
FIG. 3 is an enlarged cross-sectional view taken substantially along line 3—3 of FIG. 1.
Figure 4:
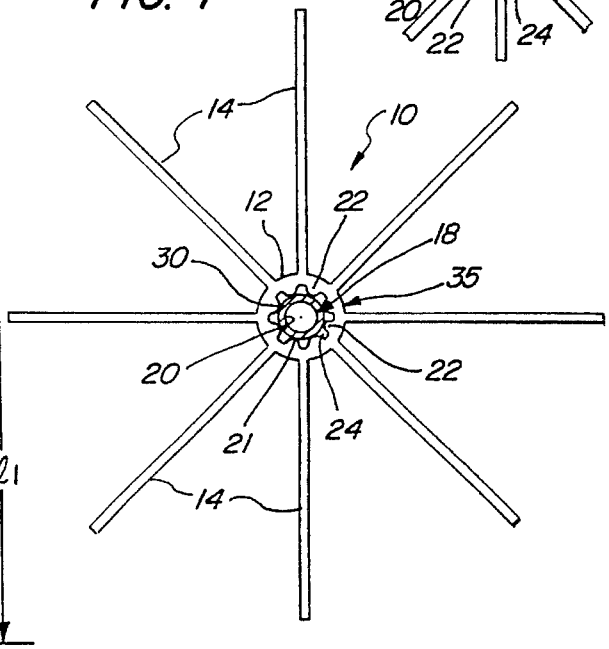
FIG. 4 is an enlarged cross-sectional view taken substantially along line 4—4 of FIG.1.

The central passage 16 in the heat exchange tube or housing 12 comprises a cylindrical opening 20 defined by substantially rounded or radicised edges 21 of a plurality of fin projecting members 22 that define a plurality of spaced, generally U-shaped, peripheral passageways 24 surrounding the cylindrical opening 20. Passageways 24 are separated by the general triangular-shaped internal fin projecting members 22. A cylindrical rod 26 having an approximate length of 7 feet and provided with a diameter substantially equal to the diameter of the central opening 20 is inserted into passageway 16 to close the central cylindrical opening 20 along a substantial length of the upper portion 28 of heat-exchange tube 12. The insertion of the solid rod 26 to block the central opening 20 and route all the cryogenic fluid through the peripheral passageways 24 increases the rate of heat transfer between the cryogenic fluid and the outer surface of the peripheral passageways 24 by a factor of 2, as compared to the heat-transfer rate in the unrestricted portion 25 (See FIGS. 1 and 3) of the tube which is located intermediate solid rod 26 and surge dampening means 18. See the '452 patent. The unrestricted portion 25 has a suitable length of no less than 1 foot. Where the overall length of the heat exchange unit 10 is forty feet, the unrestricted portion 25 may have a length of say six feet.

Surge dampening means 18 is defined by an elongated hollow tube 30 having a general length of approximately 4 to 10 feet. However, this length may vary according to the specific requirements of an ambient air vaporizer and heater unit. Where the overall unit length is forty feet the surge dampening tube may be six feet, for example. The dampening tube 30 is provided with oppositely disposed open ends 32 and 34, open end 32 defines a saturated liquid inlet, the hollow tube being mounted within the lower end portion 35 of the heat-transfer element which is generally referred to as the boiling portion of the elongated central passage 16. Liquid entering the tube of the heat-exchanger element is channeled at low velocity up through the inner finned surface of the central opening 20, and is also received in an elongated hollow tube 30 which acts as an energy absorbing means while vaporization takes place in the free space between the outside of the hollow tube and the inner surface of central passage 16 in the heat-exchange tube 12, said space being defined by peripheral passageways 24 comprising internal projecting fin members 22 surrounding the central opening 20.

No significant heat transfer takes place at the wall of hollow tube 30 within the boiling zone, since vapor generated is at a saturation temperature, the same temperature of the liquid in the hollow tube. Cryogenic liquid at the outer wall of the hollow tube is "dragged" upward by vapor pockets formed therein. Any significant liquid mass carried up and out of the annulus experiences deceleration due to sudden increase in space area defined by the unrestricted intermediate portion 25 above hollow tube 30 which defines a deceleration chamber partially filled by a static cryogenic liquid, the height of the liquid being dependent upon the total pressure drop through the annular vaporization space. This liquid height will, of course, fluctuate with the flow disturbances created and will absorb pulses resulting from dynamic instability. Vaporization of liquid inside the housing 12 takes place principally at the gas/liquid interface at the top of the liquid column, to the extent required to achieve gas/liquid equilibrium at the liquid surface.

The effect of no vaporization at the outside wall of hollow tube 30 and the resulting drag at this wall would appear to aid in the dampening fluctuations induced by the vaporization process in the annular space. The fact that the vaporizing process occurs in the more restricted annulus, rather than in an area equal to the total cross-sectional area of the heat transfer element 12, also aids in dampening the pressure surge.

It should be noted that direct heat leak by conduction through the aluminum inner fin members 22 of the transfer element that holds the elongated hollow tube 30 in place is minimal because of the near point contact between fin members 22 and hollow tube 30. The heat leak into the liquid leg results in a slight reduction in bulk density of the liquid leg, which tends to increase the liquid height somewhat.

The dampening means as described herein is used in conjunction with the invention described in the '452 patent and allows for an unrestricted space of not less than one foot in the length of the heat-transfer element. The effective operation of the dampening device described herein depends on the annular cross-sectional flow area and the length of the hollow tube 30, as well as the ratio of the inside perimeter of the heat-transfer element to the outside perimeter of the hollow tube 30. The values of these parameters are influenced by heat flux and weight rate of flow per sq. ft. of annular flow area for conditions normally encountered in single-pass ambient air vaporizers with frost/ice accumulation on external surfaces. The following parametric ranges are as follows:

(1) a single-pass heat exchanger element, as described herein, operating at pressures between approximately 50 psi to 450 psi, (and below critical pressure of the fluid);

(2) a hollow tube length that corresponds to the boiling zone of the vaporizing fluid, from the point of saturated liquid inlet to the height at which saturated vapor exists at 100% quality (this length can be between 15% to 45% of the heat-transfer element's length, but is most preferably about 30% of the heat transfer element's length);

(3) the hollow tube insert is preferably located at a minimum of 1 inch from the bottom of the heat-transfer element inlet;

(4) the ratio of tube height to annular flow area is preferably 3,000/feet to 9,000/feet, but typically around 4,800/feet;

(5) the ratio of heat-transfer element inside perimeter to the hollow tube outside perimeter is between 1.5 to 5.2, and is preferably 2.6;

(6) the amplitude of surges is reduced about 50 to 60% utilizing the invention described herein.

These ratios and dimensions apply for the following cryogenic fluids: oxygen, nitrogen, argon, methane and other cryogenic fluids with similar thermodynamic properties.

The following dimensions of the heat exchange element 10 are provided by way of example only:

| | |
|---|---|
| $l_1$ | 6' to 40' |
| $l_2$ | 38% to 68% and preferably about 50% of $l_1$ |
| $l_3$ | 15% to 45% and preferably about 32.5% of $l_1$ |
| $l_4$ | 1 foot minimum to about 17.5% of $l_1$ |
| $d_1$ | 5" to 11" |
| $d_2$ | 1" to 2" |
| $d_3$ | 0.5" to 1.0" |
| $r_1$ | 0.40" to 0.85" |

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An improved cryogenic vaporizer and heat-transfer element comprising:

a tubular housing opened at both ends and having a least one outer fin member, and a central passage formed therein including an upper portion, an intermediate portion, and a lower port ion;

a plurality of radially extending internal projections having outer contacting surfaces forming a cylindrical opening in said central passage;

a plurality of longitudinal passageways symmetrically arranged about the inner wall of said finned tube;

means for closing said upper portion of said cylindrical opening, whereby fluid flow is restricted so as to flow upward through said longitudinal passageways, said intermediate portion being unrestricted, thereby providing an enlarged area to decelerate movement of liquid therein;

dampening means mounted in the cylindrical opening of said lower portion of said central passage whereby a boiling zone for cryogenic liquid is defined so as to substantially control the amplitude of liquid surging within said central passage of said tube.

2. The improved cryogenic vaporizer and heat-transfer element as recited in claim 1, wherein the amplitude of the surges is reduced about 50 to 60%.

3. The improved cryogenic vaporizer and heat-transfer element as recited in claim 1, wherein the amplitude of the surges is reduced to about 60%.

4. The improved cryogenic vaporizer and heat-transfer element as recited in claim 1, wherein said dampening means comprises an elongated hollow tube having a saturated liquid inlet and a length that corresponds to said boiling zone of a vaporizing fluid that extends from the point of the saturated liquid inlet to a height at which saturated vapor exists at 100% quality.

5. The improved cryogenic vaporizer and heat-transfer element as recited in claim 4, wherein the ratio of the inside perimeter of the heat-transfer element to the outside perimeter of the hollow-tube is between 1.5 to 5.2.

6. The improved cryogenic vaporizer and heat-transfer element as recited in claim 4, wherein the ratio of the inside perimeter of the heat transfer element to the outside perimeter of hollow tube is 2.6.

7. The improved cryogenic vaporizer and heat-transfer element as recited in claim 4, wherein said closing means comprises an elongated solid rod mounted in said central opening and having a diameter substantially equal to the diameter of said cylindrical opening, and wherein the outer contacting surfaces of said internal projections engage said solid rod within said upper portion of said cylindrical opening.

8. The improved cryogenic vaporizer and heat-transfer element as recited in claim 1, wherein said upper portion defines a restricted area, and wherein the rate of heat transfer between the cryogenic fluid and the outer surface of said housing is increased.

9. The improved cryogenic vaporizer and heat-transfer element as recited in claim 8, wherein said intermediate portion defines an enlarged unrestricted deceleration chamber.

10. The improved cryogenic vaporizer and heat-transfer element as recited in claim 9, wherein said lower portion includes said dampening means comprising an elongated hollow tube having a saturated liquid inlet and a length that defines said boiling zone within said lower portion of said heat-transfer element.

11. In combination, a cryogenic vaporizer and heat-transfer element formed having a heat-exchange tube which includes a plurality of external fins extending radially therefrom and a central passage, a plurality of radially extending internal projections having outer contacting surfaces forming a cylindrical opening in said central passage and defining a plurality of longitudinal passageways symmetrically arranged about the inner wall of said finned tube, wherein the improvement comprises:

an upper portion, an intermediate portion, and a lower portion;

means for closing said cylindrical opening and restricting fluid flow through the longitudinal passageways of said upper portion of said central passage, said intermediate portion being unrestricted, thereby providing an enlarged area to decelerate movement of liquid therein;

dampening means mounted in said cylindrical opening of said lower portion of said central passage wherein a boiling zone for the cryogenic liquid is defined so as to substantially control the amplitude of liquid surging within said central passage of said tube.

12. The combination as recited in claim 11, wherein said damping means comprises an elongated hollow tube mounted in said lower portion having a saturated liquid inlet and a length that corresponds to said boiling zone of the vaporizing fluid that extends from the point of the saturated liquid inlet to a height at which saturated vapor exists at 100% quality.

13. The combination as recited in claim 12, wherein said upper portion include means for closing said cylindrical opening and restricting fluid flow through the longitudinal passageways of said upper portion of said central passage.

14. The combination as recited in claim 13, wherein said intermediate portion defines an enlarged unrestricted deceleration chamber.

15. The combination as recited in claim 14, wherein the amplitude of the surges is reduced between 50 to 60%.

16. The combination as recited in claim 15, wherein the amplitude of the surges is reduced to 60%.

17. The combination as recited in claim 15, wherein said closing means comprises an elongated solid rod mounted in said cylindrical opening having a diameter substantially equal to the diameter of said cylindrical opening, and wherein the outer contacting surfaces of said cylindrical opening engage said solid rod within said upper portion.

* * * * *